US007585028B2

(12) United States Patent
Jenkins

(10) Patent No.: US 7,585,028 B2
(45) Date of Patent: Sep. 8, 2009

(54) MOBILE ERGONOMIC ROTATING ADJUSTABLE CHAIR WITH LUMBAR SUPPORT

(76) Inventor: Jeffrey B. Jenkins, 1509B Leslie Ave., Alexandria, VA (US) 22301

( * ) Notice: Subject to any disclaimer, the term of this patent is extended or adjusted under 35 U.S.C. 154(b) by 405 days.

(21) Appl. No.: 11/349,987

(22) Filed: Feb. 9, 2006

(65) Prior Publication Data

US 2006/0175884 A1 Aug. 10, 2006

Related U.S. Application Data

(60) Provisional application No. 60/650,960, filed on Feb. 9, 2005.

(51) Int. Cl.
*A47C 3/00* (2006.01)
*A47C 1/023* (2006.01)
*A47C 1/024* (2006.01)

(52) U.S. Cl. ..... 297/302.3; 297/284.7; 297/344.1

(58) Field of Classification Search ..... 297/300.4, 297/302.3, 230.13, 230.14, 284.4, 284.7, 297/326, 344.1
See application file for complete search history.

(56) References Cited

U.S. PATENT DOCUMENTS 3,059,971 A * 10/1962 Becker ..... 297/353
4,979,778 A * 12/1990 Shields ..... 297/300.2
5,080,318 A * 1/1992 Takamatsu et al. ..... 248/598
5,249,839 A * 10/1993 Faiks et al. ..... 297/300.1
5,501,507 A * 3/1996 Hummitzsch ..... 297/284.4
5,577,811 A * 11/1996 Ogg ..... 297/452.15
5,704,689 A * 1/1998 Kim ..... 297/301.4
6,669,294 B2 * 12/2003 Kinoshita et al. ..... 297/354.1
6,805,405 B2 * 10/2004 Koo ..... 297/284.7
7,040,703 B2 * 5/2006 Sanchez ..... 297/353
2002/0130541 A1 * 9/2002 Koo ..... 297/284.7

OTHER PUBLICATIONS

Images of a Rhythm chair, which was believed to be commercially available circa 2000-2001.
Images of an Aeron chair, which was believed to be commercially available circa 1996.
Images of an Evo chair, which was believed to be commercially available circa 1990-1991.

* cited by examiner

*Primary Examiner*—Joseph F Edell
(74) *Attorney, Agent, or Firm*—Nixon & Vanderhye P.C.

(57) ABSTRACT

An apparatus for sitting, including: a keystone assembly which connects various parts of the apparatus; a back that provides support for at least a person's back or shoulders; a floating lumbar support, which provides support for a person's lower back, attached to the keystone assembly; a seat that can adjust between a forward tilted and reclined position; a plurality of rollers, disposed on the keystone assembly, on which the seat rests; a central column, attached to the keystone assembly, on which the seat can spin; and a lower torsion spring connected to the seat and disposed on the keystone assembly allowing controlled movement of the seat.

17 Claims, 12 Drawing Sheets

MOBILE ERGONOMIC ROTATING ADJUSTABLE CHAIR WITH LUMBAR SUPPORT

CROSS-REFERENCES TO RELATED APPLICATIONS

This application claims the benefit of Provisional Application No. 60/650,960, filed Feb. 9, 2005, the entire content of which is hereby incorporated by reference in this application.

FIELD OF THE INVENTION

The illustrative embodiments generally relate to task chairs used in a variety of everyday situations. More specifically, the illustrative embodiments relate to an ergonomic, adjustable, rotating office chair with a lumbar support, designed to provide a more natural sitting position for a sitter.

BACKGROUND AND SUMMARY OF THE INVENTION

Many conventional task chairs are designed to provide a comfortable sitting position for the sitter, but most of the designs force the sitter's body into unhealthy postures. Lumbar supports are typically attached to the back of the chair, and while the support may be adjustable, it does not provide adequate support for a sitter leaning forward in the chair. This lack of support presents a problem, as many sitters lean forward when engaging in conversation or focusing intently on a task. Even when sitters recline in most chairs, the chairs are still not designed with the proper posture in mind. There is a need for a chair that will encourage proper body posture and provide adequate lumbar support over a variety of sitter positions. By supporting continual movement of the seated person, improved spinal health and worker productivity are achieved.

One feature of the illustrative embodiments is a floating, articulating lumbar support. The support is attached to the frame of the chair by a rocker arm lever, allowing the support to move forward and backwards in response to similar movements by the sitter. The rocker arm may be attached to the back of the seat, at a rear pivot point, by a pair of steel pins. As the sitter fully reclines in the chair, the articulating lumber passes through an opening in the back of the chair, and the sitter's shoulder blades and upper spine are then supported by an auxiliary back. The back and the lumbar support may be constructed of molded glass reinforced nylon, and the rocker arm lever may be constructed of a high grade aluminum alloy, however any suitable materials may be used. A seat cushion layer of the seat may comprise a composite of renewable, blended materials, such as cork, felt, or latex, however any suitable materials may be used.

According to this illustrative embodiment, the chair also has rollers mounted under a movable, contoured seat, allowing the seat to slide smoothly from a forward tilt to a recline position. A front roller provides tracking guidance for the forward portion of the seat, and a floating spring with rollers provides guidance for the rear portion of the seat. Additionally, the rear spring with rollers helps push the seat forward as the sitter moves into a forward tilt position. The seat has a contoured bottom designed to ride smoothly over both sets of rollers. The rollers may be composed of delrin, the seat is composed of glass reinforced nylon, and the spring material is laminated carbon fiber, but any suitable materials may be used.

At the front of the seat is a pivot point where, in one illustrative embodiment, two rocker arms attach to the seat, connecting the seat to a lower torsion spring. The lower torsion spring provides the main resilience for reclining and returning to forward tilt posture. This spring is positioned low, to allow the maximum arc of movement and to lower the center of gravity of a moving user, while providing appropriate leverage for supporting the full range of movement. The pivot point may be machined steel pin, and the lower torsion spring may be made from steel and rubber covered with an aluminum housing, however any suitable pivoting connection may be used and the parts may be made from any suitable material.

The rocker arms of the lumbar support may attach to the rear of a keystone assembly by a lumbar spring assembly. The lumbar spring is a torsion spring, similar to the lower torsion spring, and the lumbar spring provides tension and resilience for the movement of the articulating lumbar support. The spring assembly may be clamped to the rear of the keystone assembly and may be attached with a steel axle to the rocker arms of the articulating lumbar support. The keystone assembly not only connects to the lumbar support, but also connects to the rollers, the lower torsion spring, and to a seat height adjustment lever and height adjustable column. The keystone assembly may be made from cast aluminum, and the lumbar spring may be made from steel and rubber and cased in aluminum, however any suitable materials may be used for construction.

According to another illustrative embodiment, the keystone assembly attaches to a height adjustable column comprised of a gas cylinder and a steel and plastic housing in a preferred embodiment. Adjustments to the seat height can be made by actuating a lever attached to the keystone assembly.

Another feature of one illustrative embodiment is a cast aluminum footrest that curves upward from a center recessed base affixed to the bottom of the central column. The recesses in the base allow clearance for the lower torsion spring when the chair is in a low height position, and consequently the chair can still shift and rotate without contact between the base and the torsion spring. The footrest creates a comfortable place for the sitter to rest his feet without interfering with chair functions. Wheels may also be attached to the end of the footrests to allow the chair to be easily moved about. In one illustrative embodiment, the central base and footrests are made of cast aluminum, however any suitable materials may be used.

The illustrative embodiments also may have several user adjustable features. Two contoured armrests may attach to the contoured seat and may be custom made to fit the individual user. The vertical position of the lumbar support may be raised or lowered to closely match the curves of a sitter's spine. In this embodiment, this adjustment is made by means of a spring button which unlocks the support and allows the user to vertically adjust the height thereof. Additionally, the back and lumbar support may be custom made or selected from a variety of custom sizes, although a standard back and/or lumbar support size may also be used.

These and other features, aspects and advantages of the instant invention will be more clearly understood from the review of the following detailed description of the invention when read in conjunction with the appended drawings, in which:

DETAILED DESCRIPTION OF THE DRAWINGS

Figure 1:
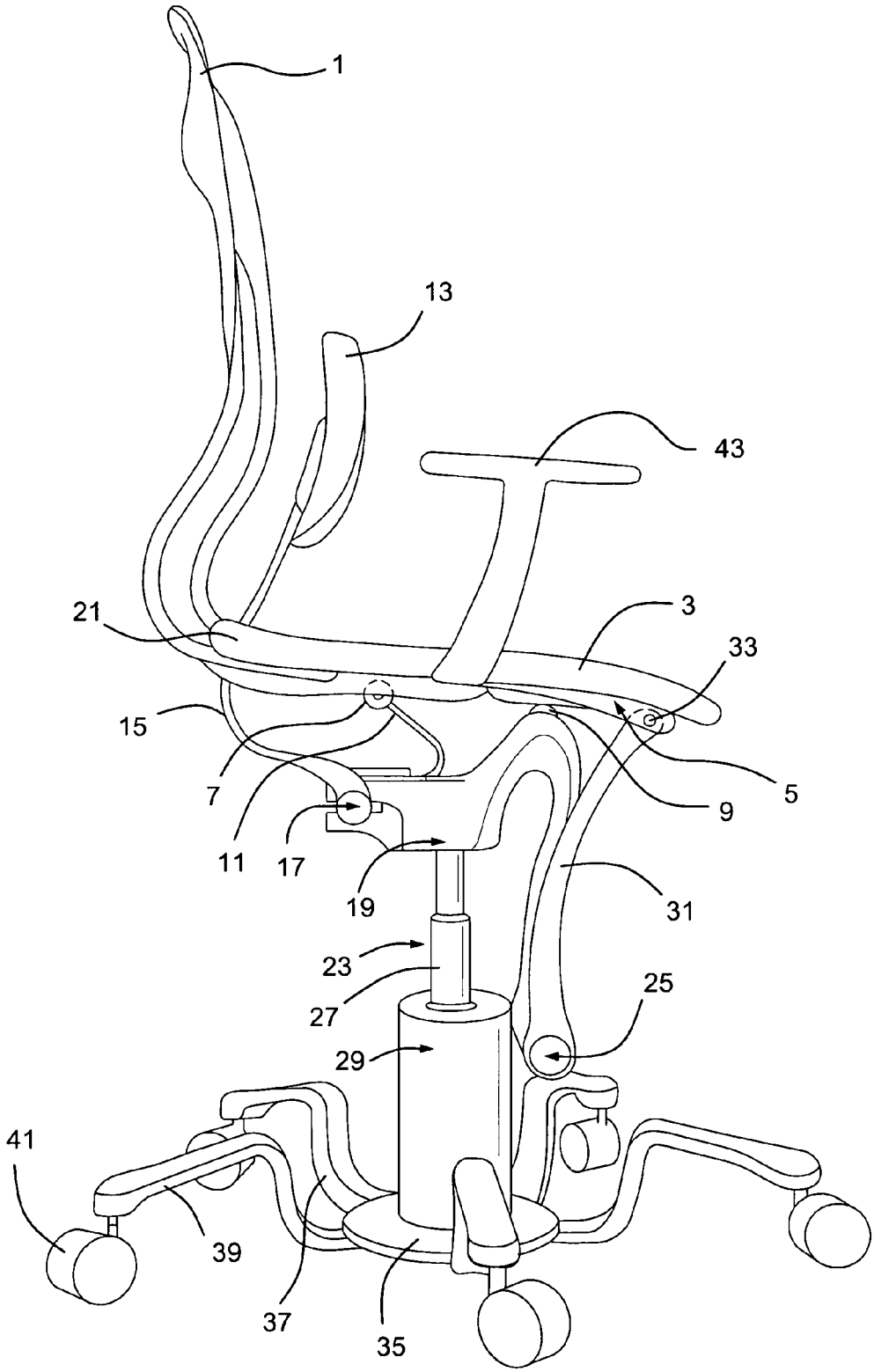
FIG. 1 shows an exemplary side elevation of an illustrative embodiment of the mobile ergonomic rotating adjustable chair with lumbar support.

FIG. 1 shows an exemplary side elevation of one illustrative embodiment of the mobile ergonomic rotating adjustable chair with lumbar support. An auxiliary back 1 provides shoulder blade and upper spine support for a sitter when the sitter is in a reclined position. According to this embodiment, the auxiliary back 1 may be selected from a variety of customized backs, or a standard back may be used. The auxiliary back 1 attaches to the contoured seat 3 and moves with the movement of the seat. The contoured seat 3, may have a layer of padding, preferably comprised of renewable composite materials, however padding may be excluded or any suitable materials may be used. The contoured seat 3 has contours 5 formed into its bottom face, and the contours slide on rollers 7, 9. The rollers allow the seat to move through a range of forward tilt to full recline as the contours move across the rollers. The rear roller 7 is attached to a floating spring 11, and the floating spring 11 acts to push the seat forward in response to a forward movement by a sitter and to support the rear of the seat in response to a rearward movement by a sitter.

As the sitter moves forward, the lumbar support 13 attached to an articulating rocker arm 15 moves forward in response. This provides constant support for the sitter's lower back, keeping the sitter's back in lordosis, the natural curvature of the spine. The articulating rocker arm 15 is attached to a lumbar spring assembly 17. The spring assembly 17 allows the rocker arm to articulate and also serves to affix the articulating rocker arm to the keystone assembly 19. The articulating rocker arm also attaches to the rear of the seat 3 at a pivot point 21.

The keystone assembly 19 attaches to a height adjustable column 23 and a lower torsion spring 25. The height adjustable column is made up of a gas cylinder 27 and a central column housing 29. The lower torsion spring 25 attaches to two rocker arms 31, which in turn attach to the front of the seat 3 at a forward pivot point 33.

The center base of the chair 35 is attached to the height adjustable column 23 and has recesses 37 to prevent contact between the lower torsion spring 25 and the chair base 35 when the chair is set at a low height position. Legs 39 extending from the chair base 35 attach to wheels 41. According to this embodiment, the arm rests 48, the lumbar support 13, and the auxiliary back 1, may be selected from a plurality of sizes to meet an individual user's needs. Alternatively, a standard size may be used.

Figure 2:
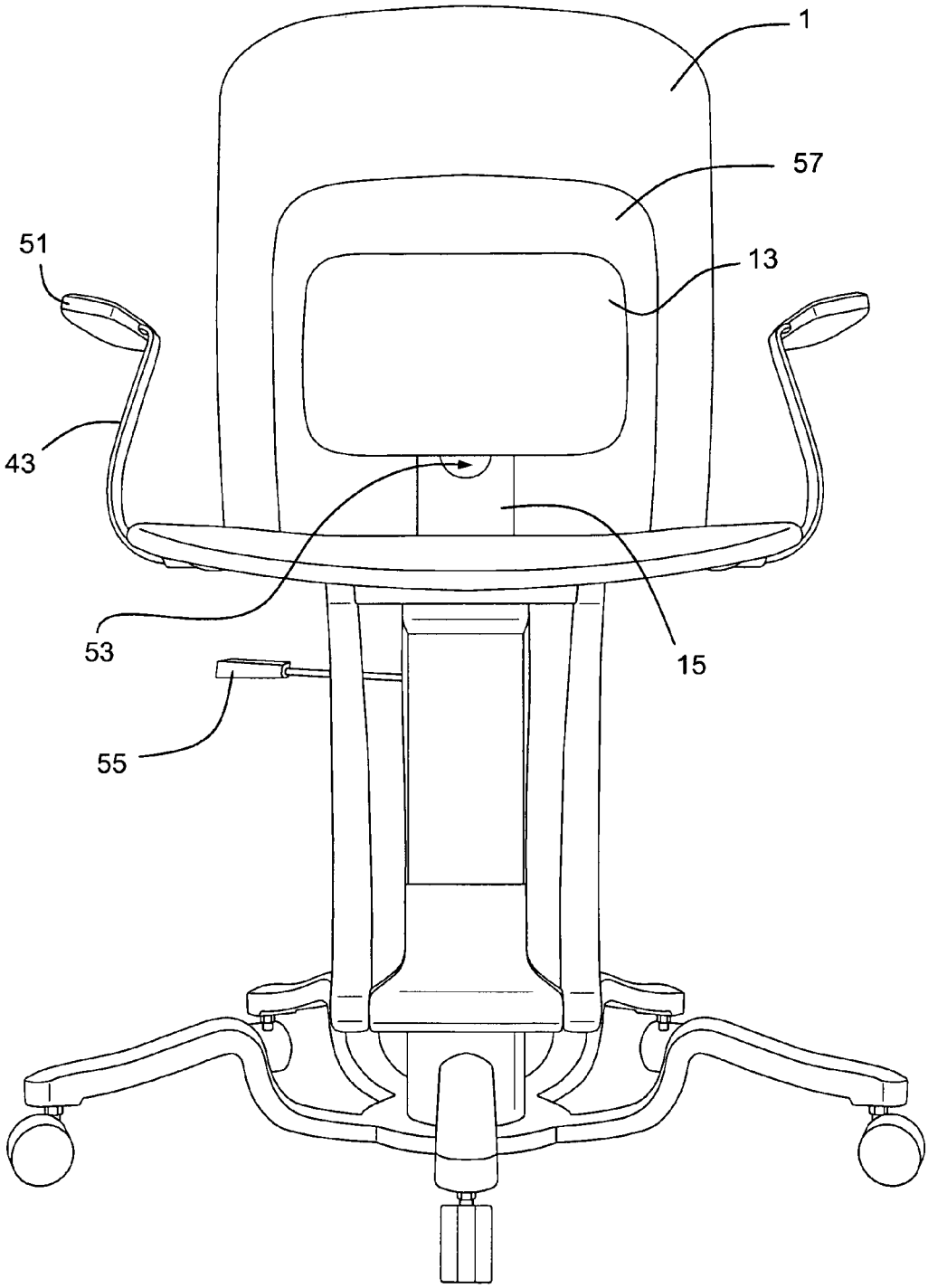
FIG. 2 shows an exemplary front elevation of an illustrative embodiment of the mobile ergonomic rotating adjustable chair with lumbar support.

FIG. 2 shows an exemplary front elevation of another illustrative embodiment of the mobile ergonomic rotating adjustable chair with lumbar support. An opening 57 in the auxiliary back 1 provides passage for the articulating lumbar support 13. When the sitter moves forward, the support 13 can pass through the opening 57 to follow the sitter's back. As the sitter moves back, the support 13 passes back through the opening 57 in response to the sitter's movement. The lumbar support 13 can also be height adjusted, sliding up and down in a gap 53 in the articulating rocker arm 15. A lever 55 allows adjustment of the height adjustable column. Two custom made arms 43 can be attached to the chair, and they can be capped by padded armrests 51.

Figure 3:
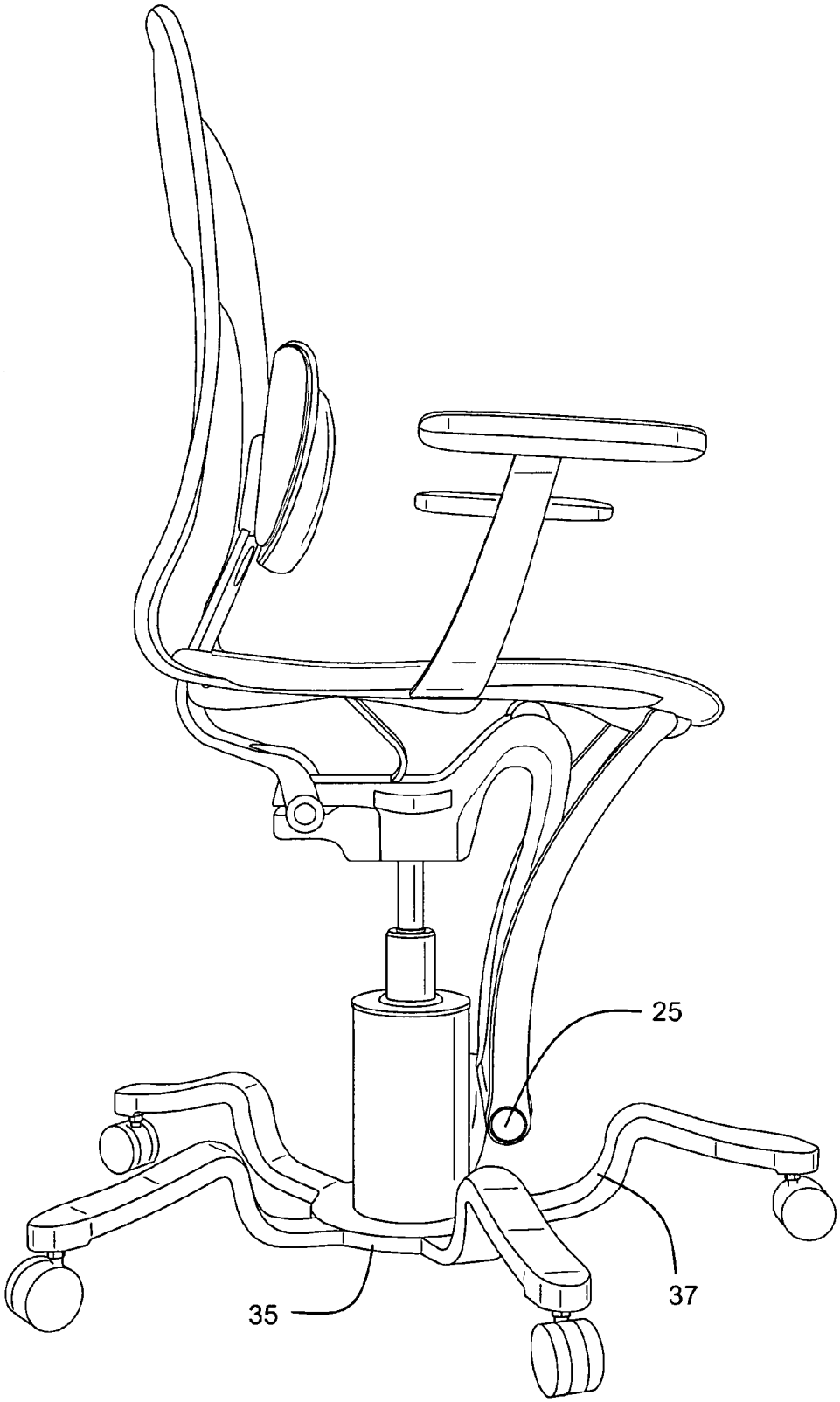
FIG. 3 shows an exemplary three-dimensional side elevation of an illustrative embodiment of the mobile ergonomic rotating adjustable chair with lumbar support.

FIG. 3 shows an exemplary three-dimensional side elevation of the mobile ergonomic rotating adjustable chair with lumbar support according to a further illustrative embodiment. From this view it is easy to see how the recesses 37 in the chair base 35 provide clearance for the lower torsion spring 25. If the sitter spins the chair, the seat 3 pivots on the central column. Because the lower spring 25 is attached to the seat, the torsion spring 25 also pivots. Since the recesses 37 are below the level of the spring 25, the spring 25 can pivot through a full 360-degrees without interference. Of course, the spring could also be mounted above the level of the chair base 35, but the lower the spring 25 the better the range of tilt movement of the seat.

Figure 4:
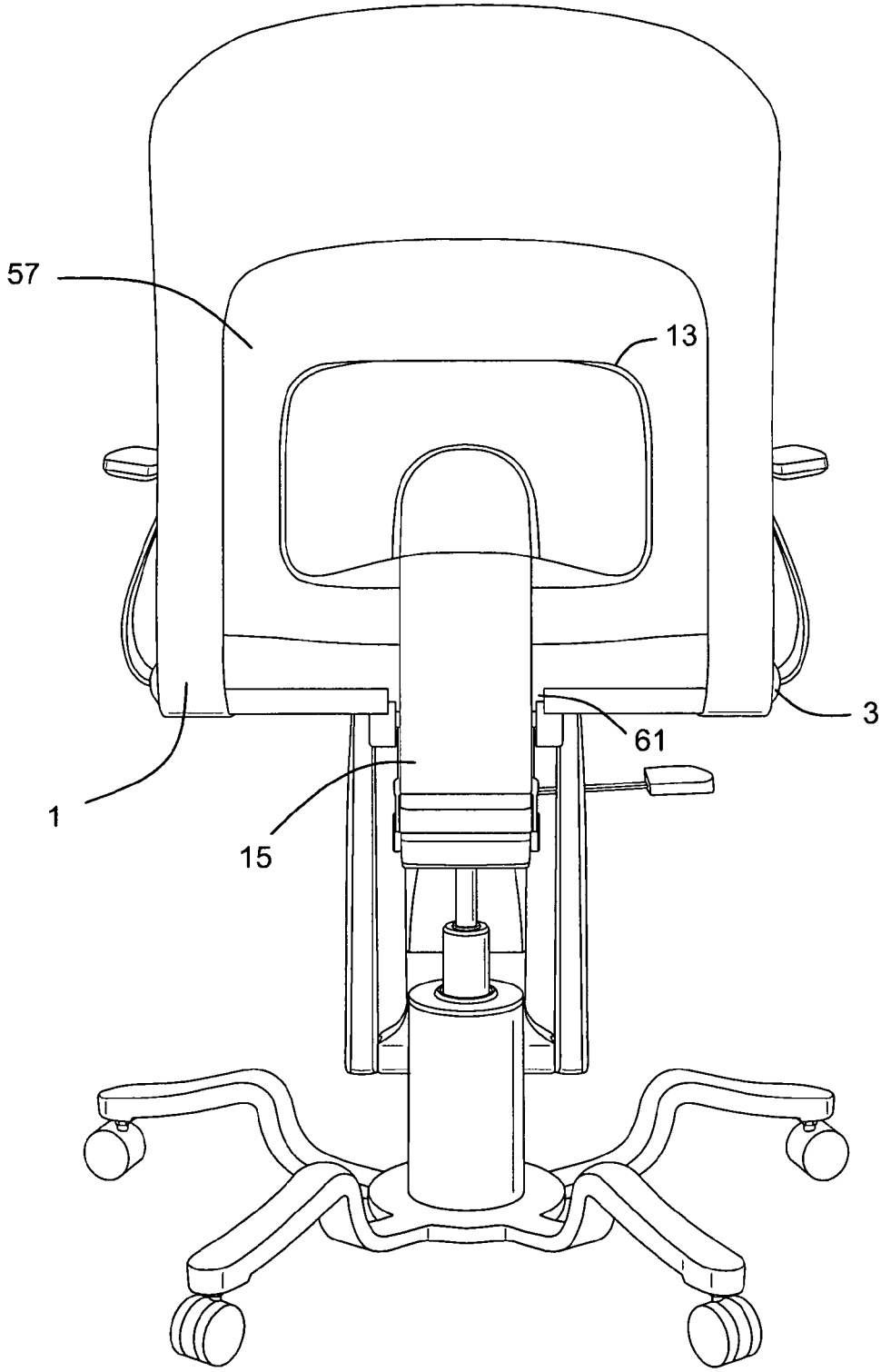
FIG. 4 shows an exemplary three-dimensional rear elevation of an illustrative embodiment of the mobile ergonomic rotating adjustable chair with lumbar support.

FIG. 4 shows an exemplary three-dimensional rear elevation of the mobile ergonomic rotating adjustable chair with lumbar support according to another illustrative embodiment. The actuating rocker arm 15 fits within a recess 61 in the rear of the seat 3. The auxiliary back 1 attaches to the bottom face of the seat 3 in the rear of the seat. When the sitter leans forward, the auxiliary back 1 moves forward in response, being fixed to the seat 3. The actuating rocker arm, pivots forward, moving the lumbar support 13 forward at a faster rate than the auxiliary back, following the sitter's spine. The recess 57 in the auxiliary back 1 allows the lumbar support 13 to cleanly move forward and backwards.

Figure 5:
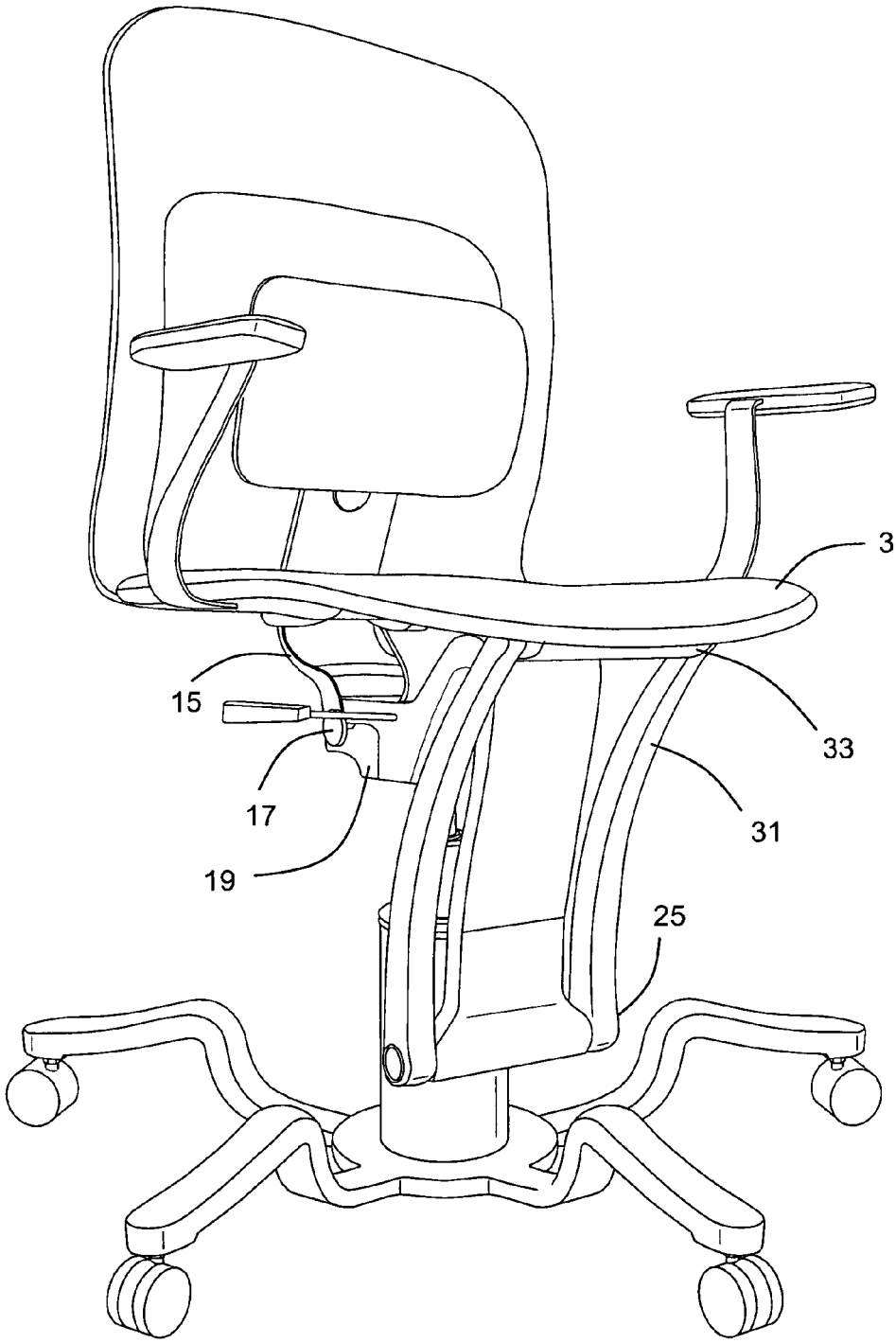
FIG. 5 shows an exemplary three-dimensional perspective view of an illustrative embodiment of the mobile ergonomic rotating adjustable chair with lumbar support from a front-left perspective.

FIG. 5 shows an exemplary three-dimensional perspective view of an illustrative embodiment of the mobile ergonomic rotating adjustable chair with lumbar support from a front-left perspective. The articulating rocker arm 15 attaches to the keystone assembly 19 at the lumbar spring assembly 17. The front rocker arms 31 attach to the seat 3 at a forward pivot point 33. Each of the rocker arms is attached to a torsion spring 17,25, which stores energy as the sitter moves forwards or backwards. These springs 17,25 push and pull the chair back into a default position when the sitter is no longer applying forward or backward pressure on the chair. The rear spring 17 also uses the stored energy to keep the lumbar support in pressured contact with the sitter's lower back.

Figure 6:
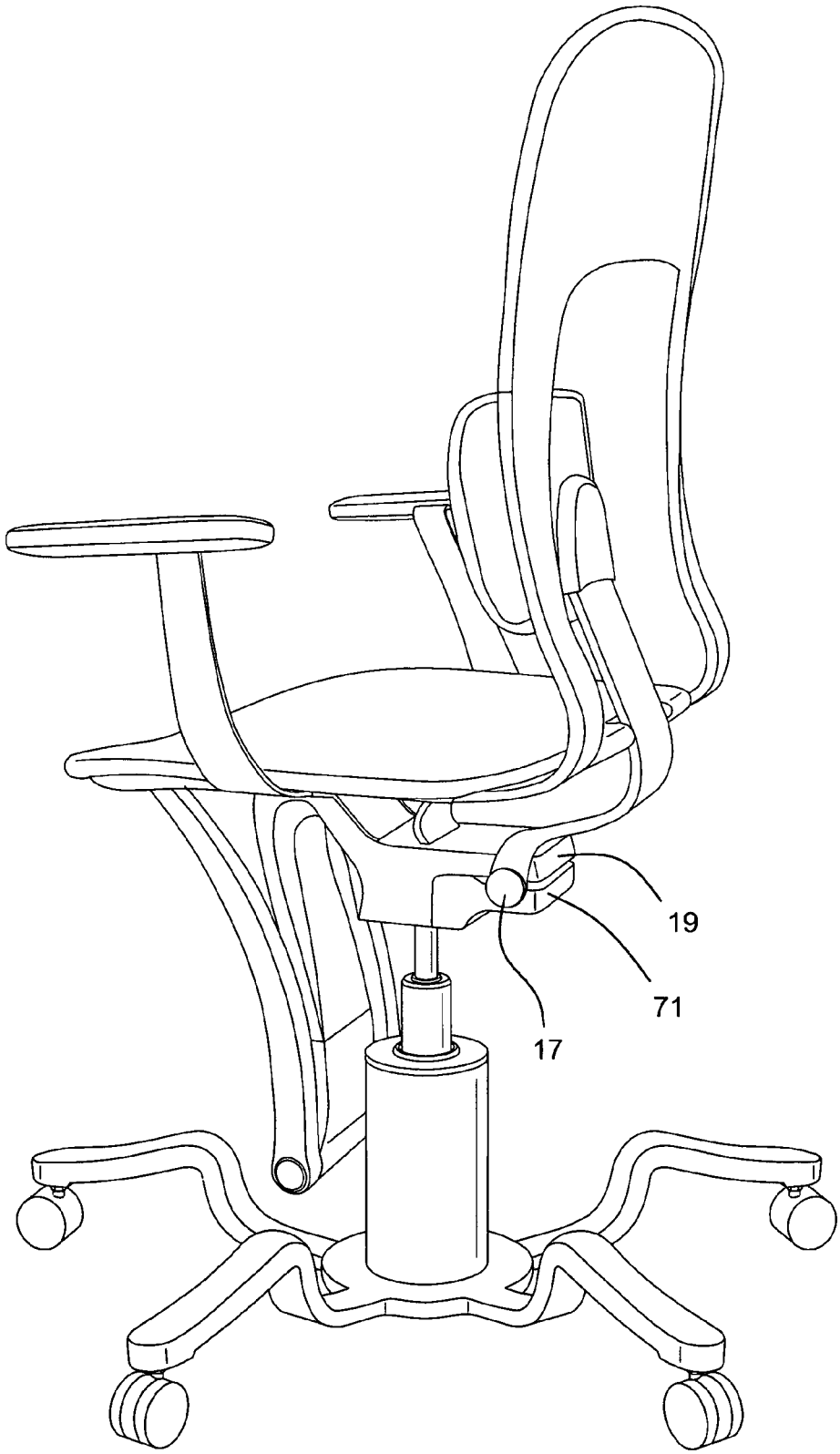
FIG. 6 shows an exemplary three-dimensional perspective view of an illustrative embodiment of the mobile ergonomic rotating adjustable chair with lumbar support from a rear-right perspective.

FIG. 6 shows an exemplary three-dimensional perspective view of an illustrative embodiment of the mobile ergonomic rotating adjustable chair with lumbar support from a rear-right perspective. The lumbar spring assembly 17 is clamped to the bottom of the keystone housing 19 by a clamping piece 71.

Figure 7:
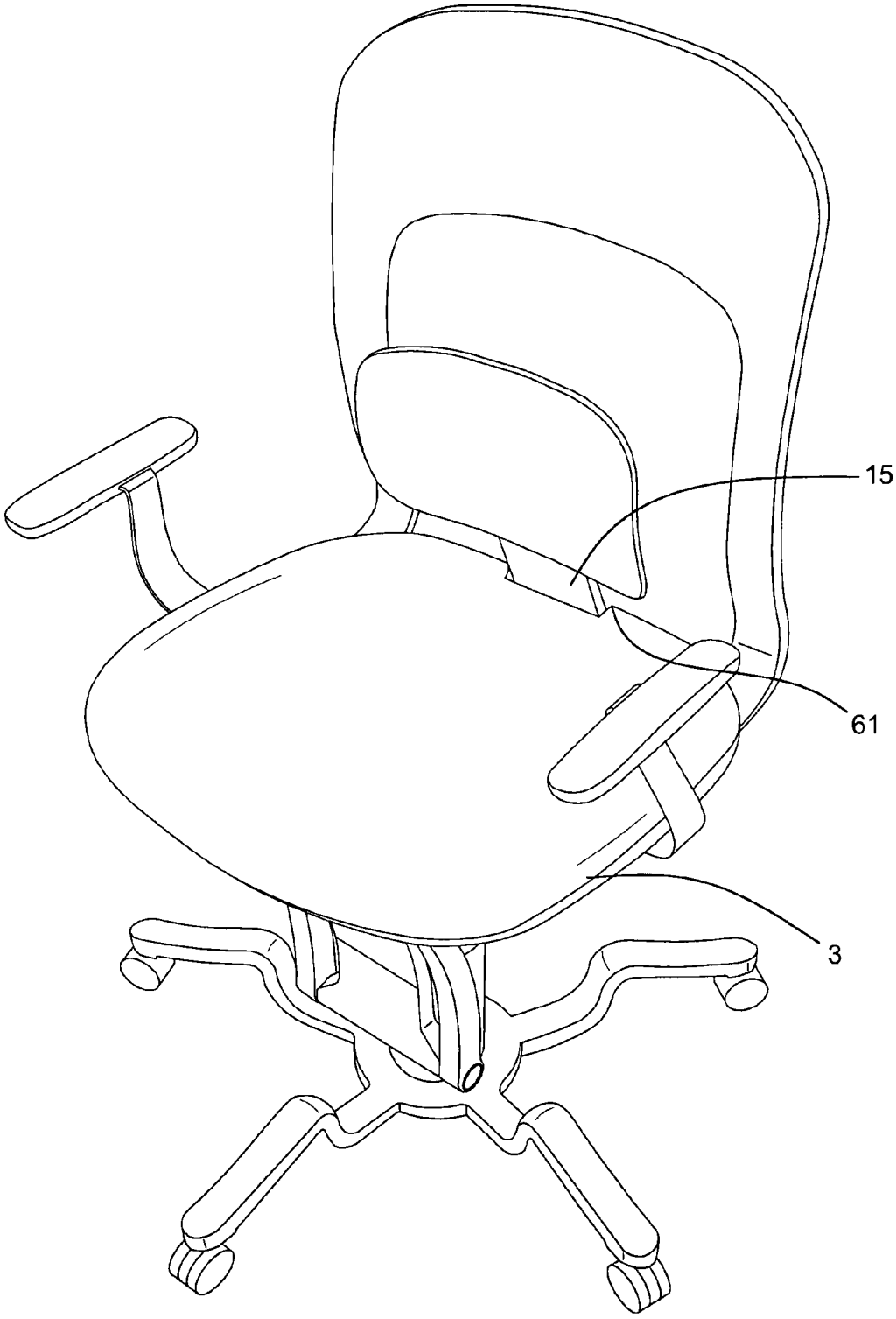
FIG. 7 shows an exemplary three-dimensional perspective view of an illustrative embodiment of the mobile ergonomic rotating adjustable chair with lumbar support from a front-right perspective above the chair.

FIG. 7 shows an exemplary three-dimensional perspective view of an illustrative embodiment of the mobile ergonomic rotating adjustable chair with lumbar support from a front-right perspective above the chair. The seat 3 has a recess 61 in the rear where the articulating rocker arm 15 of the lumbar support attaches. This recess helps prevent the seat from interfering with the movement of the rocker arm as it pivots forward and backwards. Of course, other suitable methods of attaching the rocker arm such that interference is minimized may also be used.

Figure 8C:
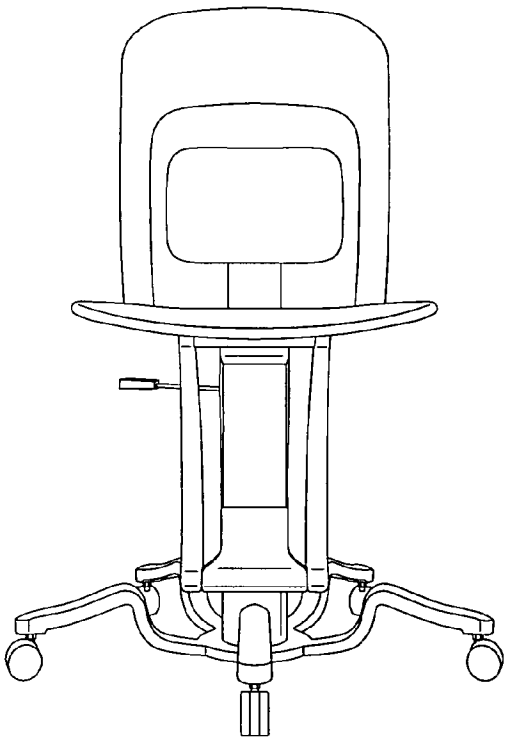
FIG. 8*c* shows an exemplary front elevation of an illustrative embodiment of the mobile ergonomic rotating adjustable chair with lumbar support.
Figure 8B:
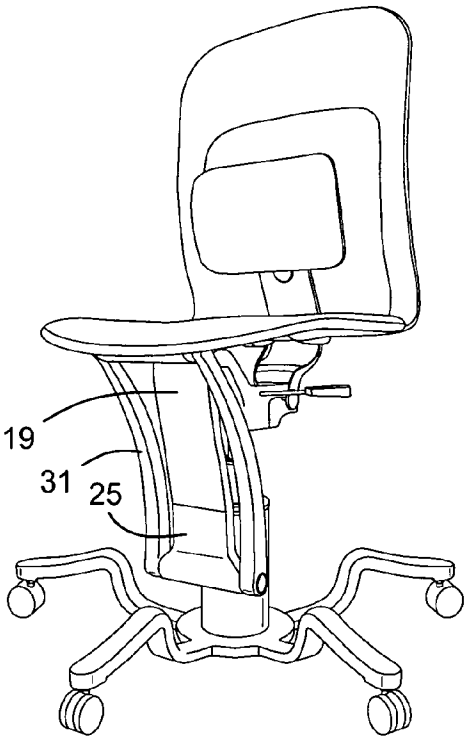
FIG. 8*b* shows an exemplary front-right perspective of an illustrative embodiment of the mobile ergonomic rotating adjustable chair with lumbar support.
Figure 8A:
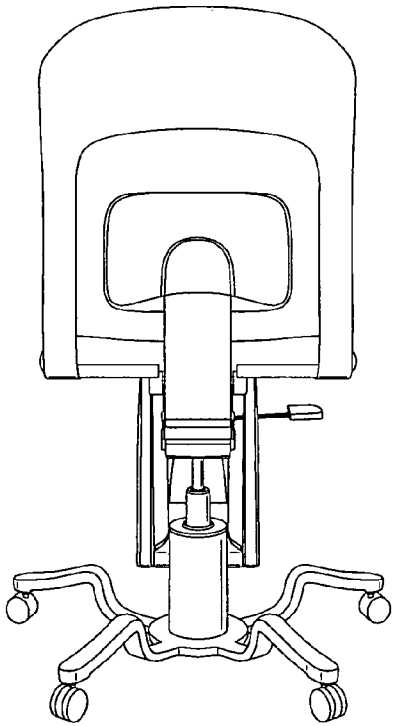
FIG. 8*a* shows an exemplary rear elevation of an illustrative embodiment of the mobile ergonomic rotating adjustable chair with lumbar support.

FIG. 8*a* shows an exemplary rear elevation of an illustrative embodiment of the mobile ergonomic rotating adjustable chair with lumbar support.

FIG. 8*b* shows an exemplary front-right perspective of an illustrative embodiment of the mobile ergonomic rotating adjustable chair with lumbar support. The lower torsion spring 25 is attached to the keystone assembly 19 and the front rocker arms 31.

FIG. 8*c* shows an exemplary front elevation of an illustrative embodiment of the mobile ergonomic rotating adjustable chair with lumbar support.

Figure 9:
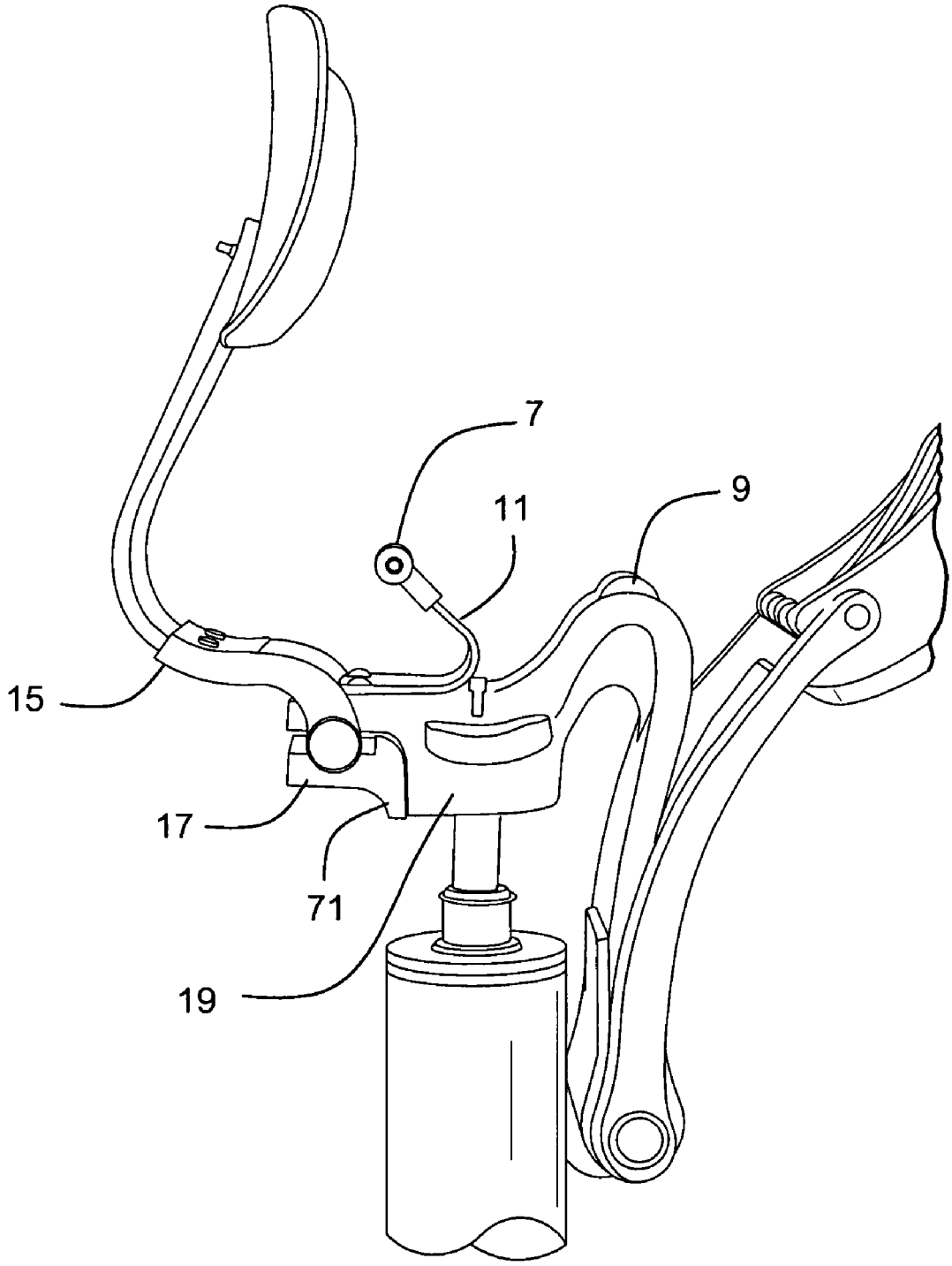
FIG. 9 shows an exemplary side elevation of an illustrative embodiment of the keystone assembly.

FIG. 9 shows an exemplary side elevation of an illustrative embodiment of the keystone assembly. The lumbar spring assembly 17 is clamped to the keystone assembly 19 by a clamping piece 71. The rear roller 7 is attached to a floating spring 11 which is in turn attached to the keystone assembly 19. The keystone assembly 19 also houses the front roller 9. The keystone assembly serves to interconnect many of the various parts of the chair, and to provide pressure and tension where it is needed in the chair.

Figure 10:
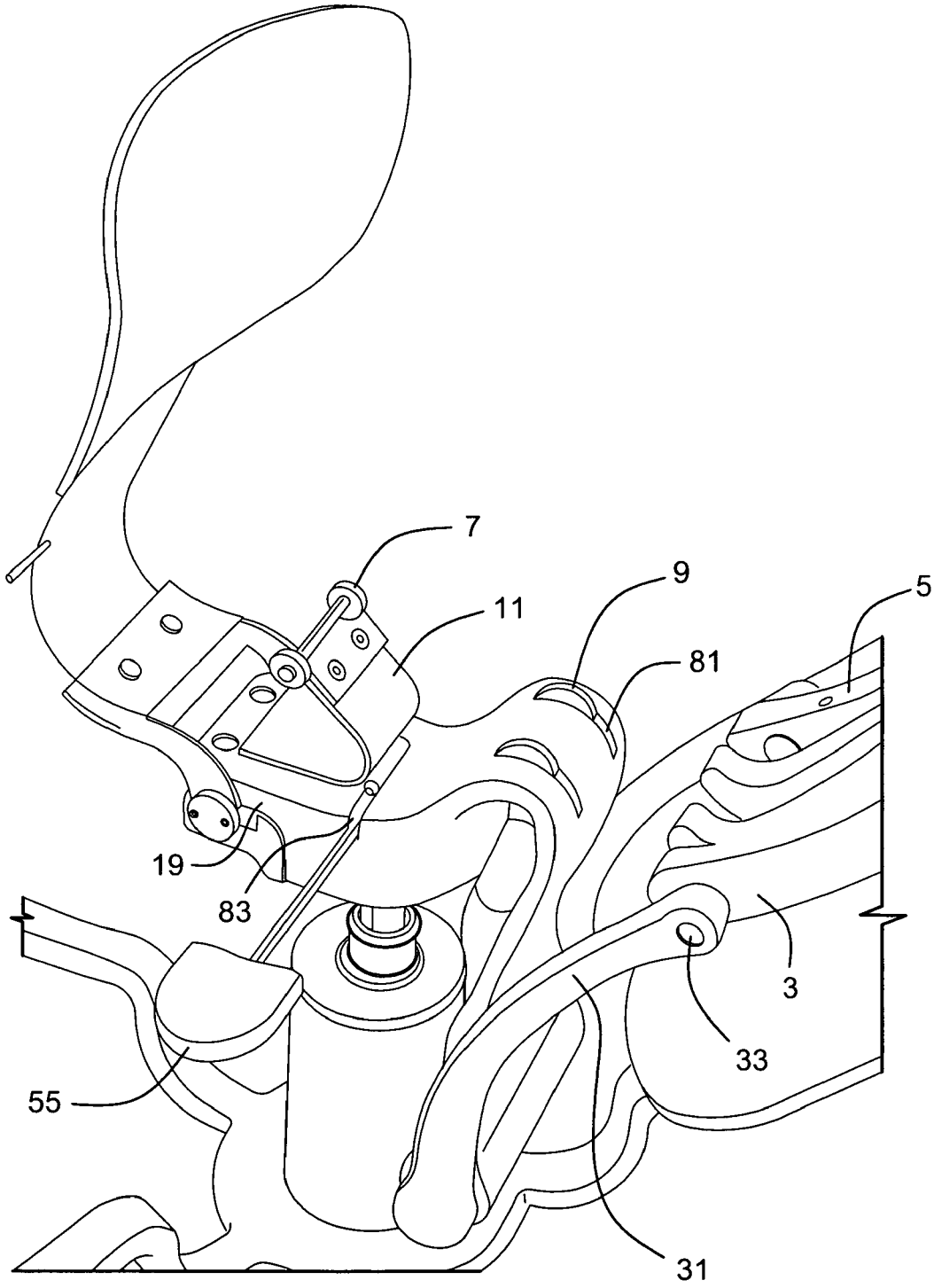
FIG. 10 shows an exemplary perspective view of an illustrative embodiment of the keystone assembly.

FIG. 10 shows an exemplary perspective view of an illustrative embodiment of the keystone assembly. The front rollers 9 sit in slots 81 cut in the keystone assembly 19. The floating spring 11 holding the rear rollers 7 attaches to the top face of the keystone assembly 19. The adjustable lever 55 also sits in a slit 83 in the keystone assembly 19. The front rocker arms 31 attach to the seat 3 at the pivot point 33 and the seat contours 5 are designed to roll smoothly over the rockers 7, 9.

Figure 11B:
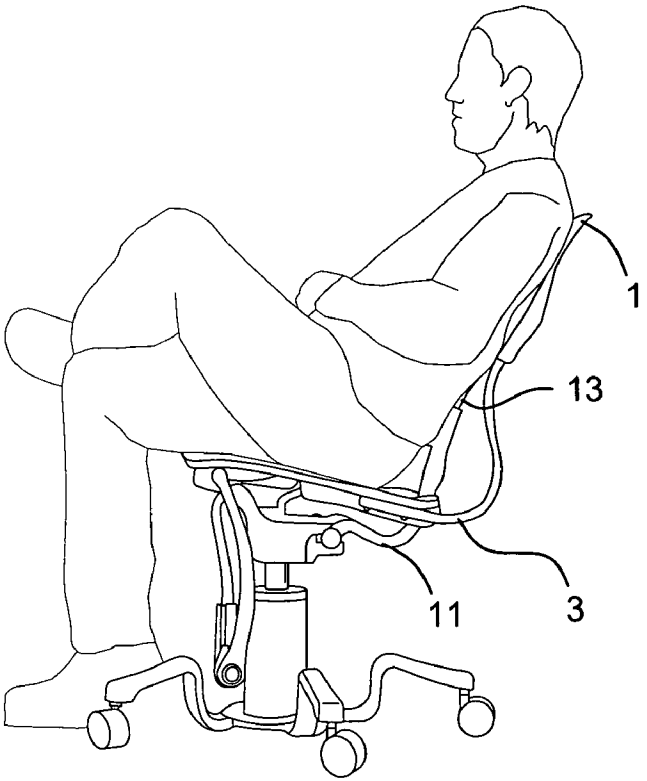
FIG. 11*b* shows an illustrative embodiment of the mobile ergonomic rotating adjustable chair with lumbar support with a sitter in a reclined position.
Figure 11A:
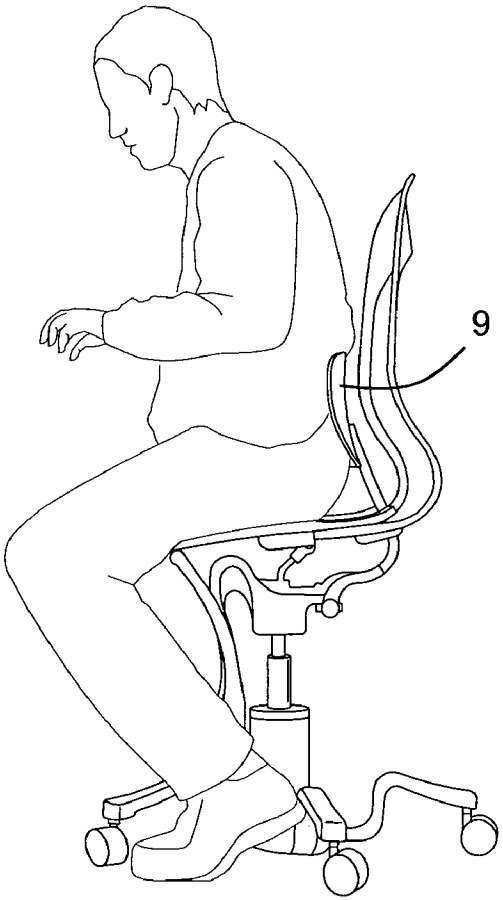
FIG. 11*a* shows an illustrative embodiment of the mobile ergonomic rotating adjustable chair with lumbar support with a sitter in a forward tilt position.

FIG. 11*a* shows an illustrative embodiment of the mobile ergonomic rotating adjustable chair with lumbar support with a sitter in a forward tilt position. The lumbar support 13 has pivoted forward to maintain pressure on the curve of the sitter's lower back.

FIG. 11*b* shows an illustrative embodiment of the mobile ergonomic rotating adjustable chair with lumbar support with a sitter in a reclined position. The lumbar support 13 has moved backwards and the auxiliary back 1 has taken the load off of the sitter's shoulder blades and upper spine. The floating spring 11 is also flexed, providing support for the rearward tilted seat 3. If the sitter moved forwards, the spring 11 would unflex, providing impetus for the forward movement.

Figure 12:
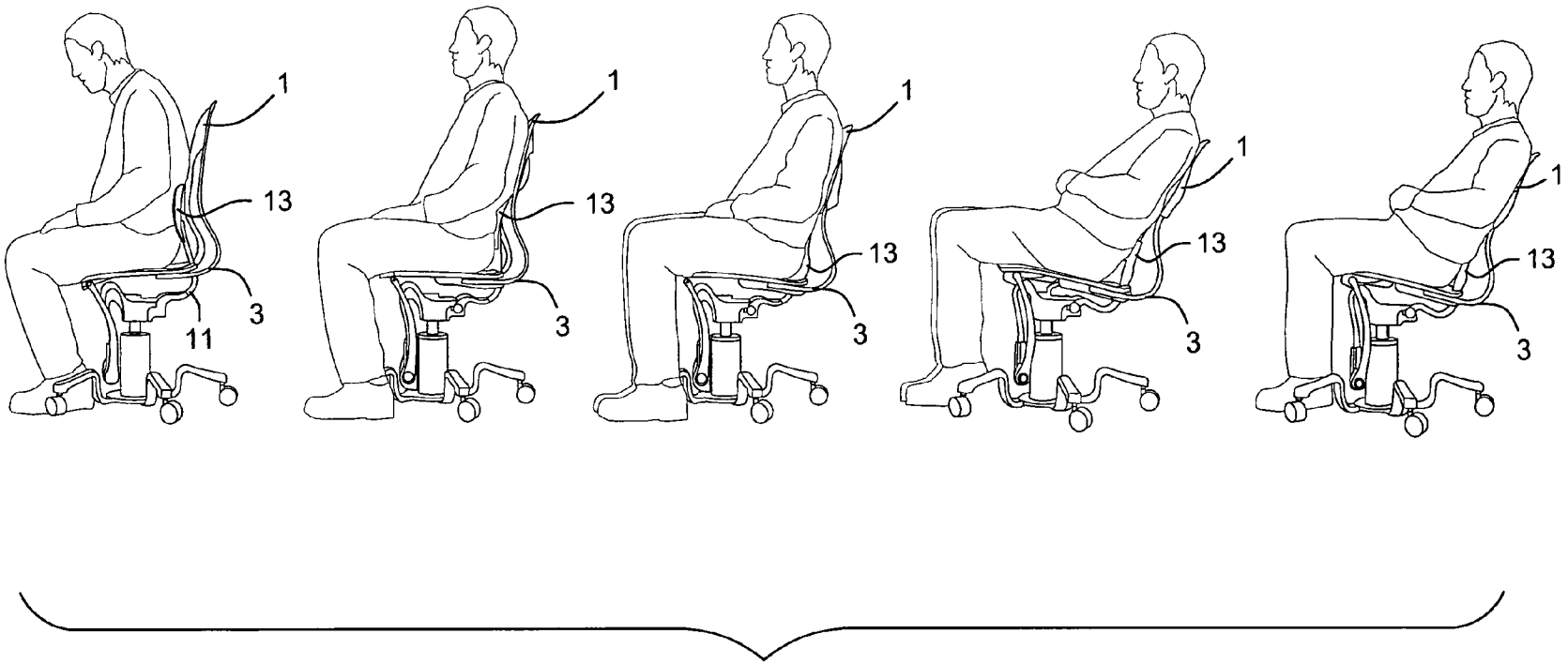
FIG. 12 shows an illustrative embodiment of the mobile ergonomic rotating adjustable chair with lumbar support progressing through a variety of sitter positions ranging from a forward tilt position to a reclined position.

FIG. 12 shows an illustrative embodiment of the mobile ergonomic rotating adjustable chair with lumbar support progressing through a variety of sitter positions ranging from a forward tilt position to a reclined position. As the sitter moves backwards towards a reclining position, the lumbar support 13 moves backwards as well, keeping constant pressure and support on the sitter's lower back and the seat 3 tilts downward in the rear to provide a more comfortable reclining position and to transfer weight to the auxiliary back 1 and pressure to the floating spring.

While the preferred forms and embodiments of the instant invention have been illustrated and described herein, various changes and modifications can be made within the scope of the invention. The invention is not limited to the specific embodiments described herein. For example, the invention is not limited to the specific sizes of the various parts indicated in the drawings. Instead, the sizes indicated herein simply reflect a preferred embodiment. The same is true with respect to the specific component shapes and materials described herein.

I claim:

1. A chair, comprising:

a seat with a back support;

a base with a column extending upwardly therefrom;

a support assembly having a body portion located on the column under the seat, the support assembly having a downwardly extending arm located below a front portion of the seat, the downwardly extending arm having a lower end located substantially below the body portion of the support assembly, the lower end having a first spring;

at least one upwardly extending arm connected from the first spring to the seat; and a floating lumbar support having a lumbar support arm connected to the support assembly via a second spring, the lumbar support arm being pivotably connected to a rear portion of the seat, wherein the first and second springs cooperate so as to enable the seat to have a combined forward-and-backward and tilting movement.

2. The chair of claim 1, wherein the at least one upwardly extending arm has an arc of movement, the downwardly extending arm being fixed in position relative to the body portion of the support assembly.

3. The chair of claim 1, wherein:

as a sitter moves from a neutral upright position to a forward tilt position, the at least one upwardly extending arm moves forward with respect to the downwardly extending arm, and the lumbar support arm pivots forward with respect to the seat, as the sitter moves from the neutral upright position to a reclined position, the at least one upwardly extending arm moves rearward with respect to the downwardly extending arm, and the lumbar support arm pivots backward with respect to the seat.

4. The chair of claim 1, wherein the at least one upwardly extending arm, the downwardly extending arm, and the lumbar support are generally parallel to one another when the chair is in a neutral position.

5. The chair of claim 4, wherein the at least one upwardly extending arm moves forward with respect to the downwardly extending arm as a sitter moves to a forward tilt position.

6. The chair of claim 5, wherein the lumbar support arm pivots forward with respect to the seat as the sitter moves to the forward tilt position.

7. The chair of claim 4, wherein the at least one upwardly extending arm moves rearward with respect to the downwardly extending arm as a sitter moves to a reclined position.

8. The chair of claim 7, wherein the lumbar support arm pivots backward with respect to the seat as the sitter moves to the reclined position.

9. The chair of claim 1, wherein:

the column is height adjustable so as to correspondingly adjust a height of the chair, and the first spring is nearly at ground level when the height adjustable column is at its lowest height.

10. The chair of claim 9, further comprising a plurality of legs attached to the base, the plurality of legs extending away from the column so as to define a recess therebetween in which the base is located.

11. The chair of claim 10, wherein recess receives the first spring as the height adjustable column is lowered.

12. The chair of claim 10, wherein each said leg comprises a plurality of leg portions, a first leg portion being connected to the base and extending outwardly and upwardly from the base, and a second leg portion extending outwardly and downwardly from an uppermost end of the first leg portion.

13. The chair of claim 1, wherein the back support is attached to the seat.

14. The chair of claim 13, wherein the back support comprises an opening through which the floating lumbar support may pass.

15. The chair of claim 1, further comprising at least one roller disposed on the support assembly, on which the seat rests and/or slides.

16. The chair of claim 15, further comprising:

a third spring connected to the body portion of the support assembly, and a floating arm extending upwardly from the third spring towards a bottom surface of the seat.

17. The chair of claim 16, wherein the floating arm has a roller on an end opposite the third spring.

* * * * *